US005228548A

United States Patent [19]

Bohlin

[11] Patent Number: 5,228,548

[45] Date of Patent: Jul. 20, 1993

[54] SINGLE LEVER CONTROL FOR BOATS

[75] Inventor: Stig F. Bohlin, Gothenburg, Sweden

[73] Assignee: AB Volvo Penta, Gothenburg, Sweden

[21] Appl. No.: 838,447

[22] PCT Filed: Sep. 10, 1990

[86] PCT No.: PCT/SE90/00576

§ 371 Date: Apr. 20, 1992

§ 102(e) Date: Apr. 20, 1992

[87] PCT Pub. No.: WO91/04192

PCT Pub. Date: Apr. 4, 1991

[30] Foreign Application Priority Data

Sep. 12, 1989 [SE] Sweden ..... 8902997

[51] Int. Cl.[5] ..... B60K 41/02; B60K 41/04

[52] U.S. Cl. ..... 192/0.096; 74/471 R; 74/877; 192/114 R

[58] Field of Search ..... 192/0.096, 114 R; 74/471 R, 877, 878, 875, 876

[56] References Cited

U.S. PATENT DOCUMENTS

| | | | |
|---|---|---|---|
| 3,146,632 | 9/1964 | Irgens | 192/0.096 X |
| 3,165,941 | 1/1965 | Morse . | |
| 3,335,618 | 8/1967 | Russey | 192/0.096 X |
| 3,438,468 | 4/1969 | Hemens | 74/471 X |
| 3,919,510 | 11/1975 | Barnes | 192/0.096 X |
| 4,090,598 | 5/1978 | Prince | 192/0.096 |
| 4,253,349 | 3/1981 | Floeter et al. | 192/0.096 X |
| 4,631,984 | 12/1986 | Jones | 74/878 |
| 5,063,817 | 11/1991 | Bogert | 74/476 X |

FOREIGN PATENT DOCUMENTS

| | | | |
|---|---|---|---|
| 0063426 | 3/1989 | Japan | 192/4 A |
| 372985 | 1/1975 | Sweden . | |
| 391903 | 3/1977 | Sweden . | |
| 434580 | 7/1984 | Sweden . | |
| 1354661 | 5/1974 | United Kingdom . | |

*Primary Examiner*—Rodney H. Bonck

*Attorney, Agent, or Firm*—Burns, Doane, Swecker & Mathis

[57] ABSTRACT

One-lever control with clutch and throttle function for marine power plants. The control lever (7) is solidly joined to a rotatable cam element (8) which actuates electrical switch (10, 11), which are connected to an electrical servo motor (S) to control the forward-reverse clutch function. A link arm (13) is pivotally joined to the cam element and a rocking lever (15) connected to a throttle control cable. The pivot joints (a, b) of the link arm and the center of rotation (c) of the cam element are arranged so that they lie on a common straight line (d) when the control lever is in the neutral position.

6 Claims, 2 Drawing Sheets

SINGLE LEVER CONTROL FOR BOATS

BACKGROUND AND SUMMARY OF THE INVENTION

The present invention relates to a single lever control with throttle and forward-reverse clutch functions for marine power plants, comprising a shaft coupled to an operating lever and rotatably journalled in a supporting element, a motion-transmitting mechanism acting between the shaft and the throttle means, and electrical switch means actuated by the turning of the shaft for controlling the electrical servo means governing the clutch function.

By far the most common known type of single lever control transmits the lever movement entirely mechanically via a first so-called push-pull or Bowden cable to the engine throttle and via a second push-pull cable to the engine clutch means on the reversable transmission. During the initial lever movement from the neutral position to drive engagement, either forward or backward, a certain delay in the throttle function is always required, so that the forward or reverse gear will have time to be engaged completely before the throttle is opened to any appreciable degree. A number of different types of lost motion mechanism has been developed to provide this delay, most of which are based on the principle of displacing the travel cable jacket as much as the control wire during initial movement of the control lever. The known lost motion mechanisms are linkage systems, cam curve systems and combinations thereof, and are relatively complicated as well as being subject to significant wear. The greater the distance from the operator seat or control console to the engine, the greater the resistance will be in the control cables and this leads to increased stresses and increased wear in the control components. When the control console is located on a flybridge, unavoidable bends contribute to increased resistance in the system and thus the maximal operating force required. The problem is particularly pronounced in the forward-reverse clutch function, since the required operating force to engage forward or reverse is significantly greater than the engine throttle function. This means that the lever movement, i.e. the mechanical advantage in the control, must be adapted to the required manual operating force in such a manner that the operator does not experience the shifting movement as being too hard. This limits the possibility of dimensioning the control for a short lever movement for engaging forward or reverse, which would have been desirable to be able to shorten the lost motion of the throttle function. A short lost motion makes it possible to simplify the lost motion mechanism.

In order to avoid the problem of wear in the components of the clutch mechanism, it has previously been suggested to have the engagement and disengagement be performed with the aid of a servo motor to thereby reduce the clutch control mechanisms in the single lever control to a pair of electrical switches and a cam element interacting therewith. Such a control, which is shown in SE-A-391 903, has the electrical switches with accompanying clutch means arranged in such a manner that the lever angle between the neutral position and either engaged position is relatively great, almost 45°. The throttle function comprises a cam follower and a cam curve arrangement to provide the relatively long lost movement required for the delay in opening the throttle.

The purpose of the present invention is generally, starting from the possibilities provided by electrical servo control of the forward-reverse clutch function, to achieve a single lever control of the type described by way of introduction, which is of simpler construction than previously known single lever controls at the same time as purely functional improvements are achievable in relation thereto.

This is achieved according to the invention by virtue of the fact that the motion-transferring mechanism comprises a link arm having, spaced from the centre of the shaft, a first pivot-joint to an element attached to the shaft and a second pivot joint to a lever element for transmitting motion to the throttle means, the pivot points of the link arm being arranged so that their centres lie on opposite sides of the shaft and on a straight line through the axis of rotation of the shaft, when the operating lever is in a neutral position wherein switch means put the servo motor in a neutral position.

The control according to the invention has no real lost motion mechanism, but rather uses instead a "progressive" motion transmission ratio between the control lever and a lever to which an operating cable is connected. For movement of the control lever within a range of 15° from the neutral position, the movement of the cable lever will be negligible and by placing the electrical switch means so that they are turned on or off within this range, forward or reverse will be engaged without opening the throttle. When the control lever is then moved further, the throttle opening will be progressively greater providing smooth acceleration to full throttle opening. This avoids the disadvantage of most known lost motion mechanisms which have means which achieve, after engagement, a sudden locking of the cable jacket, which results in a rapidly increasing throttle opening.

BRIEF DESCRIPTION OF THE DRAWING FIGURES

The invention will be described in more detail below with reference to examples shown in the accompanying drawing, where FIG. 1 shows a side view of a control according to the invention, FIG. 2 shows a partially cross-sectioned front view of the control in FIG. 1, and FIG. 3 is a perspective view of the cam element in the control.

DETAILED DESCRIPTION OF THE PREFER

Figure 3:
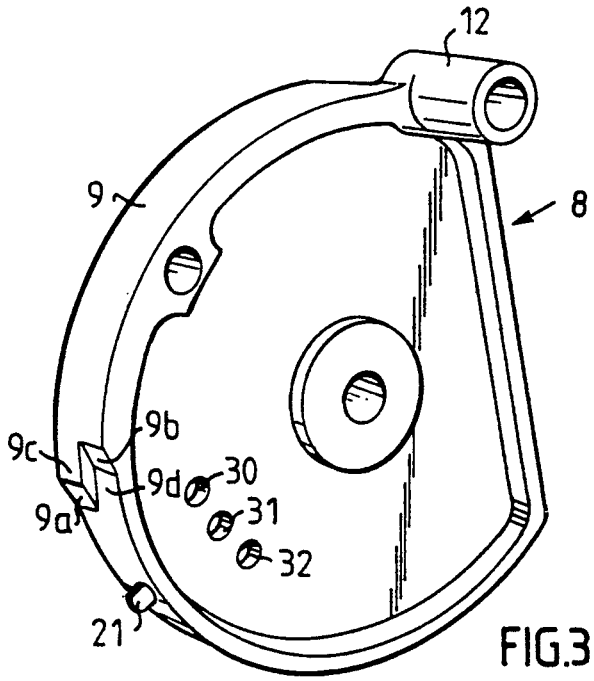

The control comprises a support plate 1 which is screwed to a bracket 2 with a hub 3, in which a shaft 4 is rotatably journalled. The supporting plate 1 extends down through an opening 5 in a control console 6, to which the bracket 2 is screwed in a manner not shown in more detail here. A control lever 7 is non-rotatably fixed to one end of the shaft 4. A cam element 8 in the form of a disc with a cylindrical surface 9 is fixed to the other end of the shaft 4. The cylindrical surface 9 forms a pair of parallel cam curves for controlling a pair of limit position switches 10, 11, and has circumferentially spaced steps 9*a*, 9*b* (FIG. 3).

The disc 8 has on its periphery an extension 12, to which one end of a link arm 13 is pivotably joined. The other end of the link arm 13 is pivotably joined at 14 to a lever 15, which in turn is pivotably mounted in the supporting plate 1. The lever 15 is pivotably joined at 16 to an operating rod 17 which constitutes an outer extension of an operating cable of push-pull type, the jacket 18 of which is fixed to the supporting plate 1 by fastener means 19.

Figure 1:
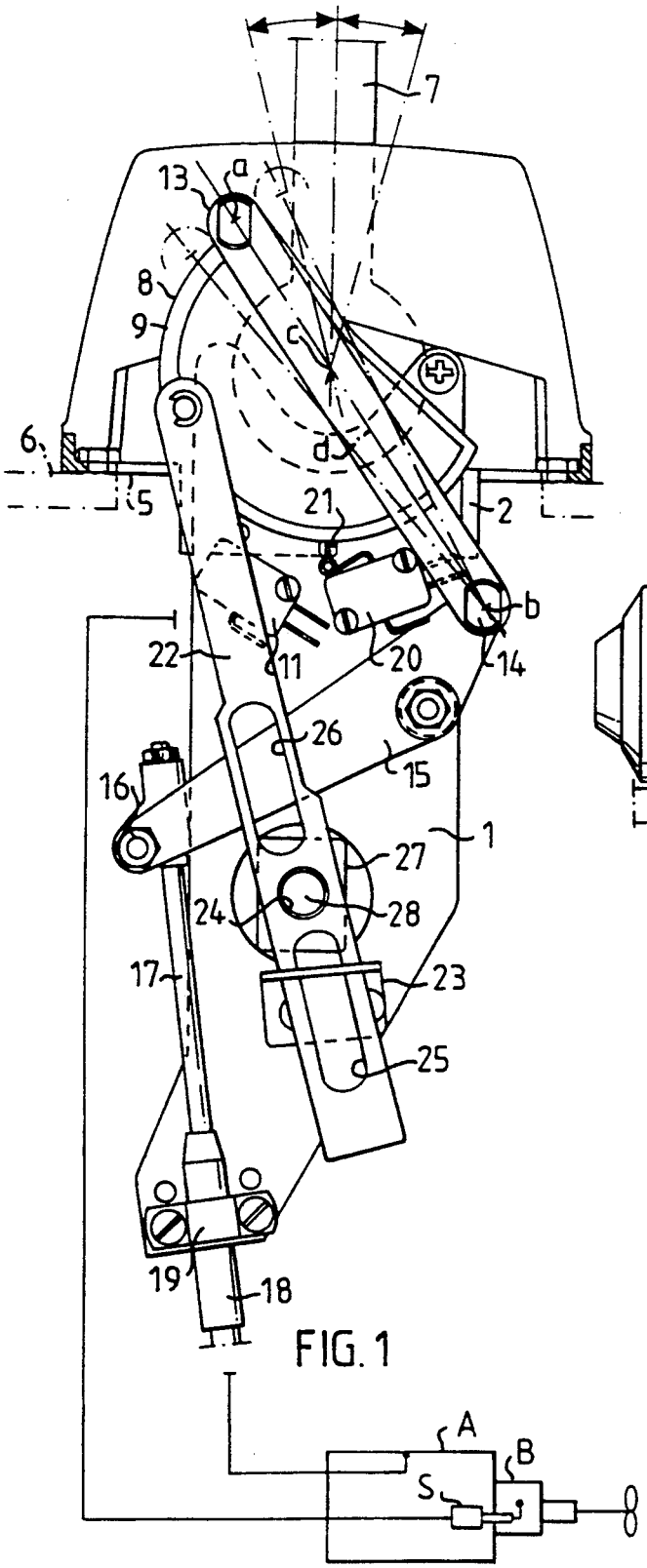
Figure 2:
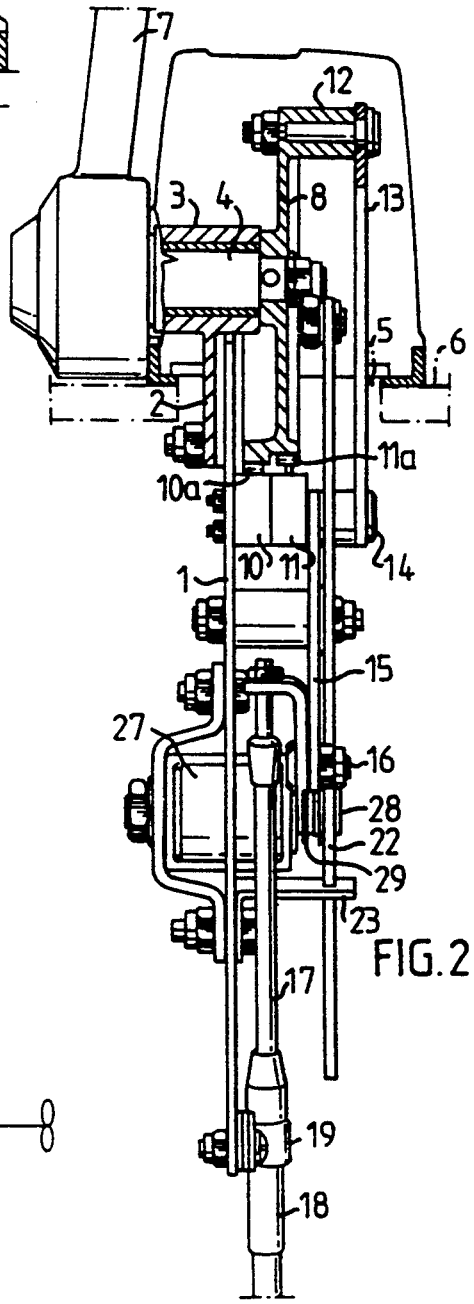

In the position of the control lever 7 shown in FIG. 1 with solid lines, the forward-reverse clutch control is in the neutral position and the throttle opening is zero. The pivot joints 12 and 14, respectively, of the link arm 13 have their centres "a" and "b", respectively, lying on a line "d" which extends through the centre "c" of the shaft 4. The clutch control is placed in the neutral position by the cam rollers 10*a*, 11*a*, of the limit position switches 10, 11, lying against cam sections 9*c* and 9*d* at different levels, so that one switch is in the on-position and the other is in the off-position, whereby an electric servo motor S, shown schematically in FIG. 1, in response to the switches 10, 11, puts the reversing transmission B to an engine A in the neutral position.

Within a sector of approximately 15° in either direction from the control lever position shown in FIG. 1, the states of the switches 10, 11 are changed by the steps 9*a*, 9*b* in such a manner that they are both put in the on-position in one control lever direction and in the off-position in the other control lever direction, whereupon the servo motor S is actuated to engage forward or reverse gear. Due to the above described geometry of the link arm 13 and the components connected thereto, a 15° movement of the control lever from the neutral position causes an insignificant change in the effective length of the disc 8 serving as a linkage arm, and thus there is a very insignificant rocking of the lever 15. In the example shown in the drawing, a 15° movement of the control lever 7 results in a displacement of the rod 17 by about 1.5 mm, which, however, is not sufficient to affect the throttle opening of the engine. This ensures that forward or reverse can be engaged by maintaining the idle r.p.m. of the engine. Continued movement of the control lever progressively increases the throttle opening, thus providing a smooth acceleration after forward or reverse has been fully engaged.

By arranging the switches 10, 11 side by side and making the cam disc 8 with parallel cam paths, represented by the steps 9*a* and 9*b* and the surfaces on either side thereof, a compact and simple design is achieved which provides engagement of forward or reverse with short control lever movement. There is also space for a third switch 20 for controlling other functions. In the example shown, the switch 20 is actuated by a thin projection 21 which turns the switch on in the neutral position of the lever.

The control is equipped with a blocking mechanism which prevents, on one hand, unintentional engagement and, on the other hand, unintentional returning of the control lever to the neutral position. This mechanism comprises a slide 22 pivotally joined to the cam disc 8. The slide 22 is displaceably mounted in a bracket 23 fixed to the supporting plate. The slide 22 is made with a circular hole 24 and a pair of oblong holes 25, 26 on either side thereof. On the supporting plate there is fixed an electromagnet 27 which has a cylindrical bolt 28 which is loaded by a spring 29 towards the slide 22.

In the neutral position of the control lever, the slide 22 is set so that the bolt 28 is directly in front of the circular hole 24 and, if the electromagnet 27 is in its unmagnetized state, the spring 29 keeps the bolt inserted into the hole 24 and thereby locks the control lever in the neutral position. By turning on the current to the magnet 27 by means of a switch (not shown), which can suitably be placed on the control lever handle, the bolt is drawn out of the hole 24 and the neutral position lock is removed. As soon as the control lever has been moved out of the neutral position, the switch button on the control lever handle can be released, and the current to the magnet 27 is broken. Under the influence of the spring 29, the bolt is then inserted into one of the holes 25 or 26. These are dimensioned corresponding to the range of movement of the control lever and permit throttle opening between idle and full throttle opening but prevent disengagement of forward or reverse, as the case may be, unless the magnet 27 has first been activated so that the bolt is first pulled away from the slide. The locking function against unintentional disengagement was developed for the purpose of preventing the boat from becoming completely unmanageable in the event that a loss of current should occur without the operator noticing it, this being a distinct possibility in boats with diesel engines, which are not dependent on electric current for their operation. Without this locking function, the bolt 28 would always automatically snap into the hole 24 when the lever is moved to the neutral position, and without current to the magnet 27 it would thereafter not be possible to open the throttle again.

This arrangement also prevents disengagement during "panic braking" with sudden throttle closing. The strongest braking force is obtained by engine braking with forward engaged until the speed has been reduced, whereafter reverse can be engaged effectively by going directly past the neutral position with the interlock button depressed.

If there is more than one control station, the lock mechanism can also prevent engagement and throttle opening from more than one control station at the time.

The invention provides a simple control requiring very little manual force. In order to achieve distinct engagement positions, a bracket (not shown) with a spring-biased ball is arranged on the supporting plate 1 between the plate and the disc 8. Three holes 30, 31, 32 are disposed in the disc (FIG. 3) on a circular arc directly opposite the ball. In the neutral position, the ball is in the centre hole 31, and as the control lever is moved from the neutral position, the ball snaps into the hole 30 or the hole 32 to indicate that forward or reverse has been engaged.

I claim:

1. A single-lever control with throttle and forward-reverse clutch functions for marine power plants, comprising:

a shaft coupled to an operating lever and rotatably journalled in a supporting element;

a motion-transmitting mechanism acting between the shaft and a throttle means, the motion-transmitting mechanism comprising a cam curve element attached for rotation to the shaft, a link arm, having a first pivot-joint spaced from the center of the shaft attached to the cam curve element and a second pivot-joint attached to a lever element for transmitting motion to the throttle means, said lever element being arranged to be rotatable about a fixed point on the supporting element, the pivot-joints of the link arm being arranged so that their centers lie on opposite sides of the shaft and on a straight line through the axis of rotation of the shaft when the operating lever is in a neutral position; and electrical switch means actuated by the turning of the shaft for controlling an electrical servo means governing the forward-reverse clutch functions, wherein the switch means comprise at least two limit position switches with switch actuating means acted upon by individual cam curve portions, at least one of said switch actuating means, under the influence of the associated cam curve portion, changing the state of its switch upon an initial rotation of the shaft in one direction from the neutral position, and at least the other changing the state of its switch upon a corresponding rotation in the other direction.

2. The control according to claim 1, wherein the switches are fixed next to each other on the supporting element, and parallel cam curves are formed on a cylindrical surface on the cam curve element.

3. The control according to claim 1 wherein the motion-transmitting mechanism further comprises blocking means cooperating with a locking device comprising a solenoid operated locking element, which in the neutral position and with the solenoid unmagnetized, locks the control lever in the neutral position in cooperation with said blocking means.

4. The control according to claim 3, wherein said blocking means are constructed so that they, through cooperation with the locking element, when the solenoid is not magnetized, prevent the control lever from being moved to the neutral position after being moved therefrom.

5. The control according to claim 3 wherein said blocking means comprise a slide pivotally connected to the shaft and displaceable in a guide, with at least one hole engageable with a locking element in the form of a slidable bolt, said hole lying directly opposite the locking bolt in the neutral position of the control lever.

6. The control according to claim 5, wherein the slide is provided with oblong holes on either side of the first-mentioned hole, said oblong holes being disposed relative to the locking bolt so that they permit, when the solenoid is not magnetized, the control lever to be moved outside the neutral position, but prevent it from being moved to the neutral position.

* * * * *